US006009624A

United States Patent [19]

Apprille, Jr. et al.

[11] Patent Number: 6,009,624

[45] **Date of Patent: *Jan. 4, 2000**

[54] RAZOR CARTRIDGE WITH MOVABLE BLADES

[75] Inventors: Domenic Vincent Apprille, Jr., Arlington; Stephen Cabot Metcalf, Newton; Vincent P. Walker, Jr., Bridgewater, all of Mass.

[73] Assignee: The Gillette Company, Boston, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/940,583

[22] Filed: Sep. 30, 1997

[51] Int. Cl.[7] ..... B26B 21/22

[52] U.S. Cl. ..... 30/50; 30/48

[58] Field of Search ..... 30/47–50

[56] References Cited

U.S. PATENT DOCUMENTS

| | | | |
|---|---|---|---|
| 1,290,641 | 1/1919 | Munroe . | |
| 1,890,334 | 12/1932 | Muros . | |
| 1,911,996 | 5/1933 | Gaisman . | |
| 4,270,268 | 6/1981 | Jacobson | 30/47 |
| 4,378,633 | 4/1983 | Jacobson | 30/47 |
| 4,378,634 | 4/1983 | Jacobson | 30/47 |
| 4,442,598 | 4/1984 | Jacobson | 30/47 |
| 4,488,357 | 12/1984 | Jacobson | 30/57 |
| 4,492,024 | 1/1985 | Jacobson | 30/87 |
| 4,492,025 | 1/1985 | Jacobson | 30/87 |
| 4,498,235 | 2/1985 | Jacobson | 30/47 |
| 4,551,916 | 11/1985 | Jacobson | 30/50 |
| 4,573,266 | 3/1986 | Jacobson | 30/41 |
| 4,621,424 | 11/1986 | Jacobson | 30/41 |
| 5,063,667 | 11/1991 | Jacobson | 30/41 |
| 5,402,574 | 4/1995 | Milner | 30/41.5 |
| 5,416,974 | 5/1995 | Wain | 30/50 |
| 5,761,814 | 6/1998 | Anderson et al. | 30/50 |
| 5,787,586 | 8/1998 | Apprille et al. | 30/47 |

FOREIGN PATENT DOCUMENTS

| | | |
|---|---|---|
| WO 92/17322 | 10/1992 | European Pat. Off. . |
| WO 93/10947 | 6/1993 | European Pat. Off. . |
| 4313 371 A1 | 10/1993 | Germany . |
| 416 377 | 1/1967 | Sweden . |
| 1587317 | 4/1981 | United Kingdom . |
| WO 91/14546 | 10/1991 | WIPO . |
| WO 94/11163 | 5/1994 | WIPO . |

OTHER PUBLICATIONS

International Search Report, Jan. 15, 1999.

*Primary Examiner*—Douglas D Watts
*Attorney, Agent, or Firm*—Fish & Richardson P.C.

[57] ABSTRACT

A razor cartridge comprising a housing having an elongated blade receiving region defined between two side walls spaced from each other along parallel first axes and between a guard and a cap spaced from each other along parallel second axes that are transverse to the first axes, the housing also having blade-receiving slots in the side walls that face each other and extend along third axes that are transverse to both the first and second axes, and elongated blade members having blades with cutting edges that are parallel to the first axes and bent supports that extend downward from the blades and have support ends at the ends of the blade members that are mounted for movement in the slots along the third axes, the slots being defined by front stop portions and back stop portions of the housing on opposite sides of respective first and third axes, the front stop portions being located underneath the blades, the back stop portions being located along respective first axes outside of the front stop portions in a direction away from the blade receiving region.

11 Claims, 5 Drawing Sheets

RAZOR CARTRIDGE WITH MOVABLE BLADES

BACKGROUND OF THE INVENTION

The invention relates to razor cartridges having movable blades.

In one type of movable-blade razor cartridge design, as shown for example in U.S. Pat. No. 4,378,634, blades are mounted on bent blade supports having upper portions that support the blades at the desired angle and lower base portions that are bent with respect to the upper portions and can slide up and down in slots in a cartridge housing against resilient arms during shaving. (Such blades and blade supports are shown in FIGS. 5–7 herein.) The base portions of the bent blade supports extend to the sides beyond the upper bent portions and the blades. The bent blade supports are made from sheet metal that has been stamped and bent. The stamping operation causes burrs at the ends of the supports, and these burrs are oriented forward when the blade supports and attached blades are mounted in the cartridge housing.

The slots of the cartridge housing have back stop portions and front stop portions that define, between them, the region in which the blade supports can move forward and backward as they slide up and down in the slots during shaving. The front stop portions are beyond the ends of the blade, so as not to interfere with movement of the blade. When the blade is centered in the cartridge housing, the burrs at the ends of the blade supports are located beyond the front stop portions; if a blade shifts to one side, it is possible for a burr to be aligned with a front stop portion where it could potentially interfere with up and down movement of the blade support.

SUMMARY OF THE INVENTION

The invention features, in general, a razor cartridge that includes a housing and blade members. The housing has an elongated blade receiving region that is defined between two side walls that are spaced from each other along parallel first axes and between a guard and a cap spaced from each other along parallel second axes that are transverse to the first axes. The housing also has blade-receiving slots in the side walls that face each other and extend along third axes that are transverse to both the first and second axes. The elongated blade members have blades with cutting edges that are parallel to the first axes and bent supports that extend downward from the blades and have support ends at the ends of the blade members that are mounted for movement in the slots along the third axes. The slots are defined by front stop portions and back stop portions of the housing on opposite sides of respective first and third axes, the front stop portions being located underneath the blades, the back stop portions being located along respective first axes outside of the front stop portions in a direction away from the blade receiving region.

Implementations of the invention may include one or more of the following features. In certain implementations, the back stop portions are higher than the front stop portions. The support ends of the blade members extend along the first axes beyond the blades. The slots also include anti-rolling members located on the same side of the first axes as the front stop portions beyond the blades. The anti-rolling members are higher than the front stop portions. The front stop portions have surfaces that make an angle of less than 1 degree (preferably less than ½ degree and most preferably less than about ¼ degree) with the third axes. The back stop portions have surfaces that are parallel to the third axes. The front stop portions and back stop portions have surfaces in planes that are spaced by a distance that is less than or equal to 0.09 mm (0.0035") greater than the thickness of the bent support. The support ends have burrs that face toward the guard.

Embodiments of the invention may include one or more of the following advantages. Placing front stop members inward under the blades permits tightening the space allowed for the base portion of the bent blade support, without risking contact of the burrs at the ends of the blade support against the front stop members. Tightening the space in which the blade support slides provides more consistent blade position and consistent blade angle during shaving. The anti-rolling members prevent the bent blade supports and the blades from rotating forward under extreme force conditions, e.g., associated with dropping the cartridge.

Other advantages and features of the invention will be apparent from the following description of the preferred embodiment thereof and from the claims.

DESCRIPTION OF THE PREFERRED EMBODIMENTS

Figure 1:
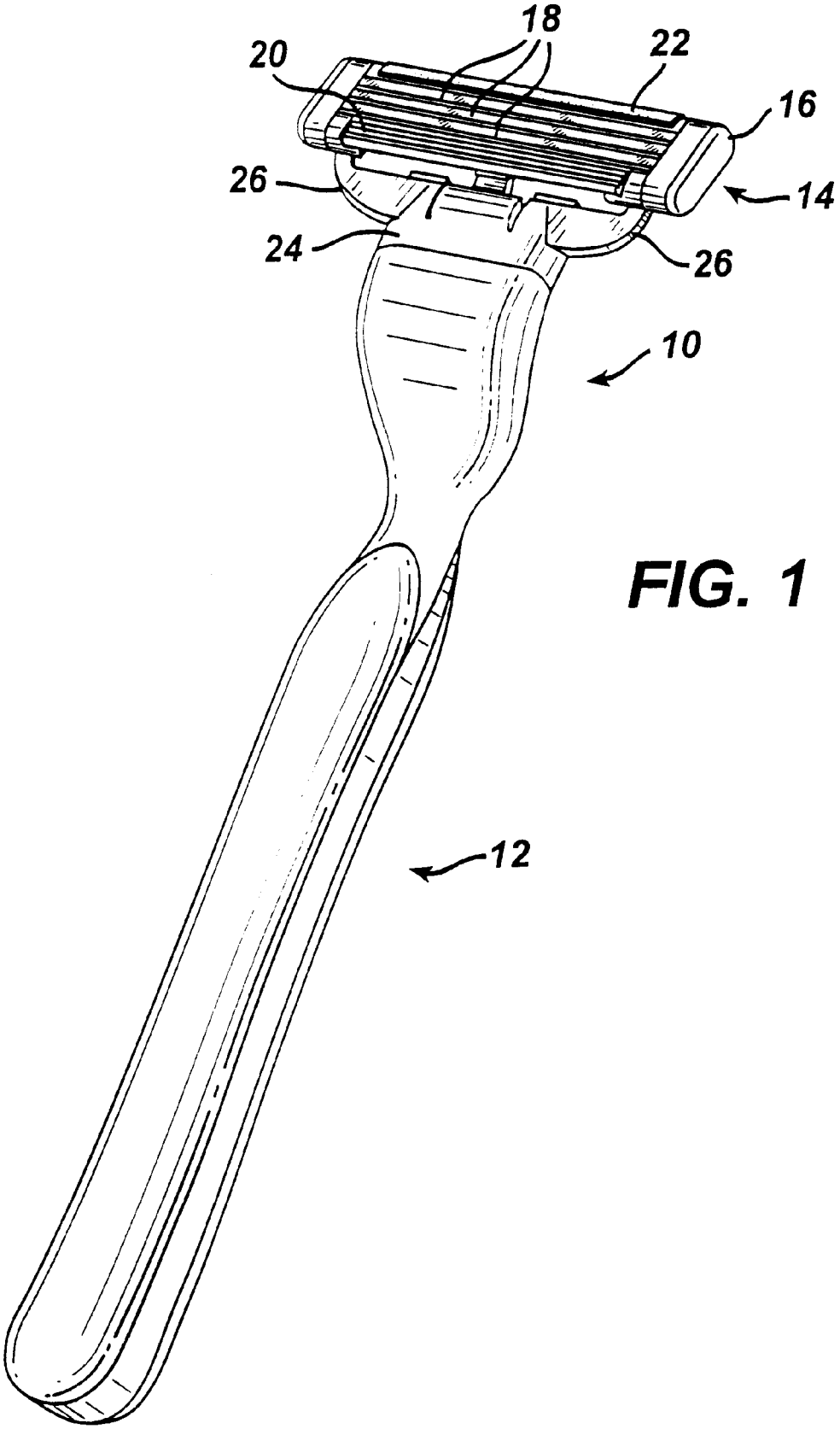
FIG. 1 is a perspective view of a razor according the invention.

Referring to FIG. 1, shaving razor 10 includes handle 12 and replaceable shaving cartridge 14. Cartridge 14 includes molded plastic housing 16, which carries three blades 18, guard 20 and cap 22. Cartridge 14 also includes interconnect member 24 on which housing 16 is pivotally mounted. Interconnect member 24 removably and fixedly attaches to handle 12 and has two arms 26 that pivotally support housing 16 at its two sides. Cartridge 14 is shown in its spring-biased, upward position in FIG. 1.

Referring to FIGS. 2–4 and 8, housing 16 of cartridge 14 has inwardly facing slots 28 in side walls 30 for receiving the ends of base portions 32 of bent blade supports 34 for blades 18. Housing 16 also has respective resilient arms 36 on which each blade support 34 is resiliently supported. Blades 18 and their supports 34 are located in a substantially unobstructed region 38 between side walls 30 to provide for ease of rinsing of the cartridge during use.

Figure 4:
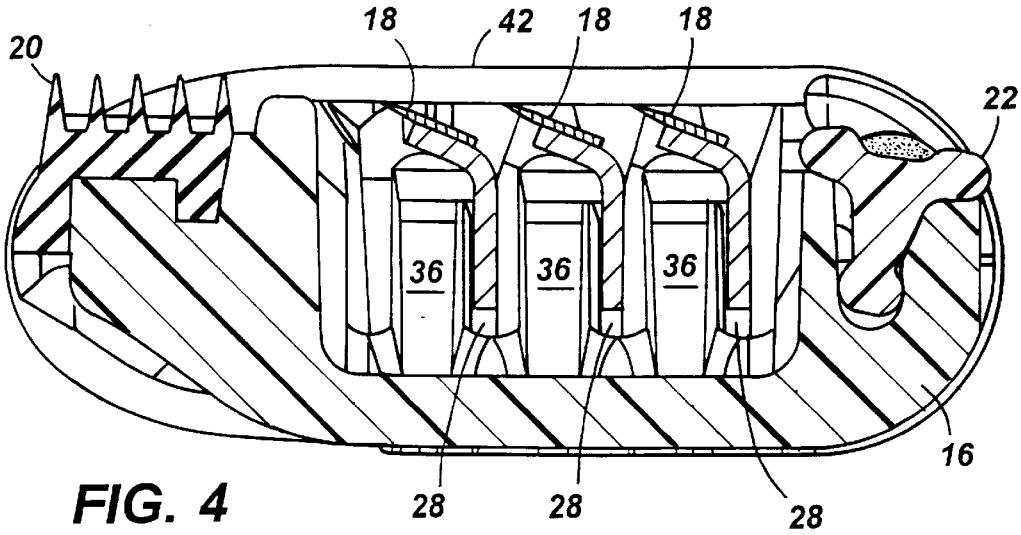
FIG. 4 is a vertical section of the FIG. 2 blade unit.

Cap 22 provides a lubricous shaving aid and is received in slot 40 at the rear of housing 16. Cap 22 may be made of a material comprising a mixture of a hydrophobic material and a water leachable hydrophilic polymer material, as is known in the art and is described, e.g., in U.S. Pat. Nos. 5,113,585 and 5,454,164, which are hereby incorporated by reference. Guard 20 includes a finned elastomeric unit molded on the front of housing 16 to engage and stretch the user's skin; other skin engaging protrusions, e.g., as described in U.S. Pat. No. 5,191,712, which is hereby incorporated by reference, can be used. Clips 42 are secured at the respective sides of housing 16 inside of raised edges 44 of side walls 30 in order to retain blades 18 within housing 16 and to locate the cutting edges of the spring-biased blades at a desired exposure, as shown in FIG. 4. Clips 42 also wrap around the bottom of housing 16 and prevent the removal of the ends of arms 26 of interconnect member 24.

Figure 2:
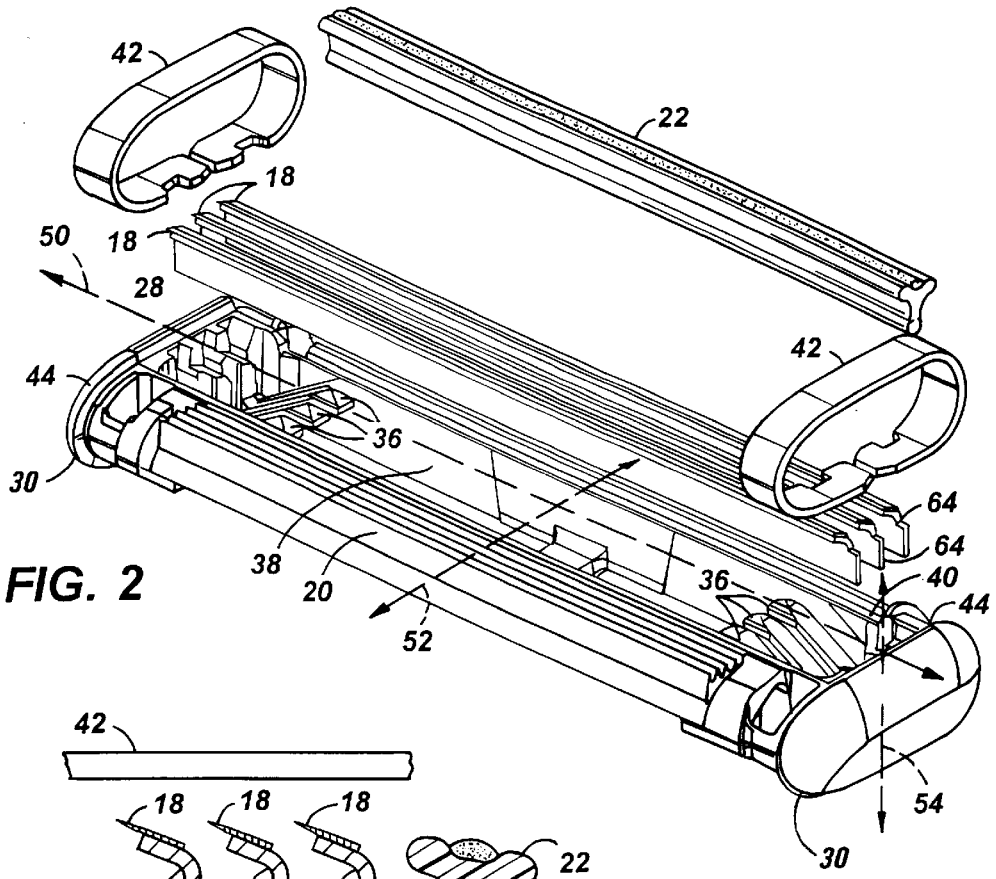
FIG. 2 is an exploded perspective view of a blade unit of a cartridge of the FIG. 1 razor.
Figure 3:
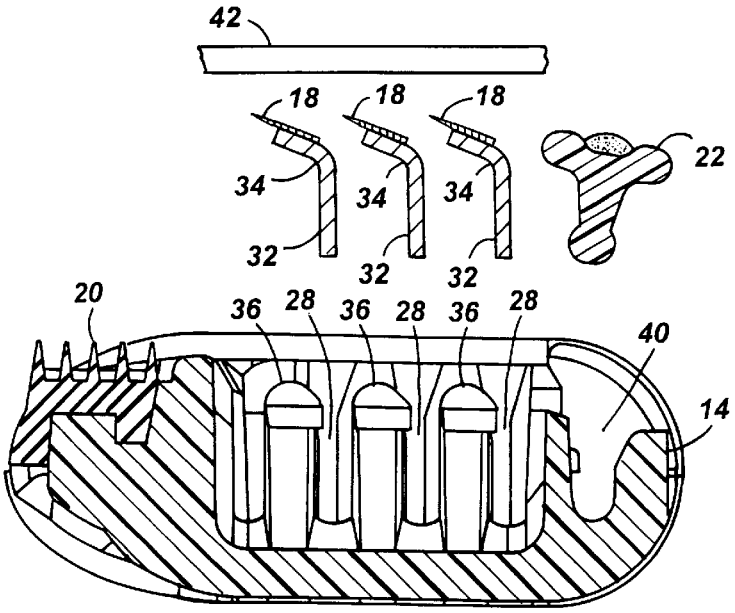
FIG. 3 is an exploded sectional view showing components of the FIG. 2 blade unit.

FIG. 2 shows representative members of three sets of reference axes 50, 52, 54. The two side walls 30 are spaced from each other along parallel first axes 50. Guard 20 and cap 22 are spaced from each other along second parallel axes 52, which are perpendicular to axes 50. Slots 28 extend along third axes 54 which are perpendicular to both axes 52 and 50.

Figure 5:
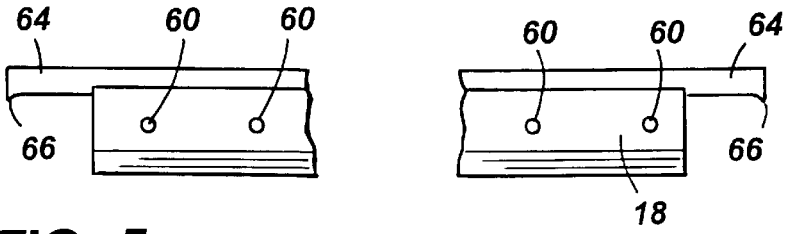
FIG. 5 is a plan view of a blade member of the FIG. 2 blade unit.
Figure 6:
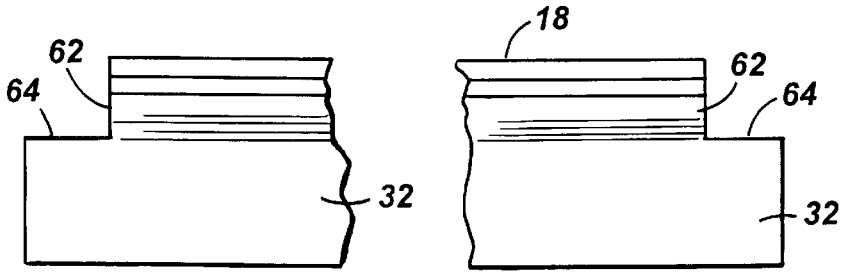
FIG. 6 is a front elevation of the FIG. 5 blade member.
Figure 7:
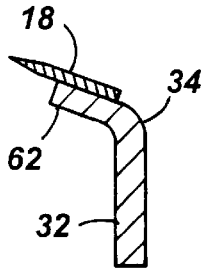
FIG. 7 is a vertical section of the FIG. 5 blade member.
Figure 8:
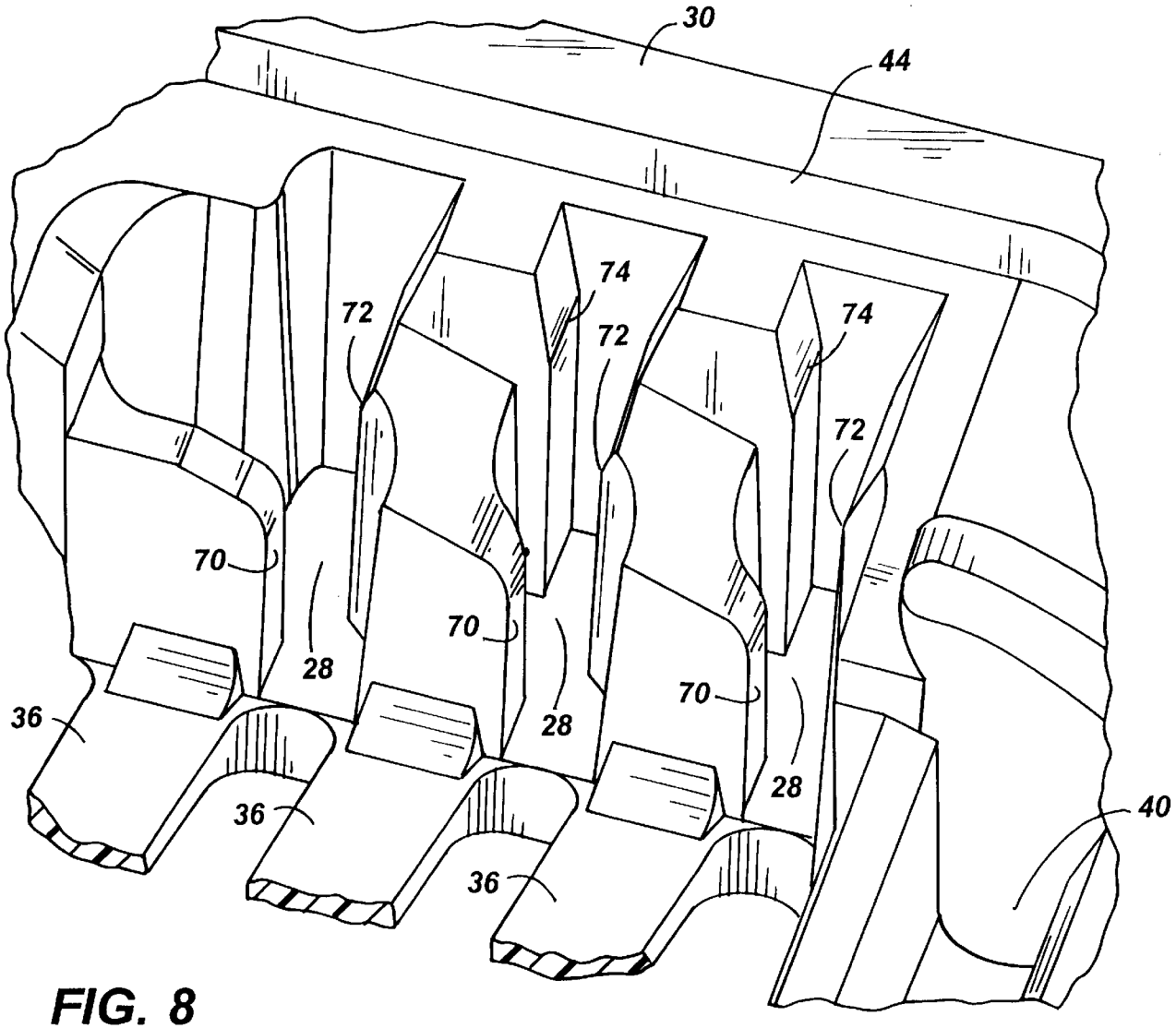
FIG. 8 is a partial perspective view, on an enlarged scale, showing the relative positions and heights of front and back stop members and anti-rolling members at slots in a housing of the FIG. 2 blade unit.

Referring to FIGS. 5–7, it is seen that blade 18 is welded at welds 60 to upper portion 62 of blade support 34. Base portion 32 of blade support 34 extends beyond blade 18 and upper portion 62 at support ends 64. Support ends 64 have burrs 66 which are created during stamping of bent supports 34. Burrs 66 are directed forward toward the front of the cartridge when mounted on housing 16.

Referring to FIGS. 8, 9, 10 and 11, it is seen that slots 28 at the ends of housing 16 are partially defined by front stop portions 70 and back stop portions 72. On FIG. 9, the end of a blade 18 and its bent support 34 are shown in phantom. On FIG. 10, the blade 18 and its bent support 34 are shown in side view in phantom. It is seen from these figures that front stop portions 70 are located underneath upper portions 62 of blade supports 34. It is also seen (from FIGS. 8 and 9) that back stop portions 72 are located outward of front stop portions 70 (i.e., closer to the end of the housing) and are behind support ends 64 of blade supports 34.

Figure 9:
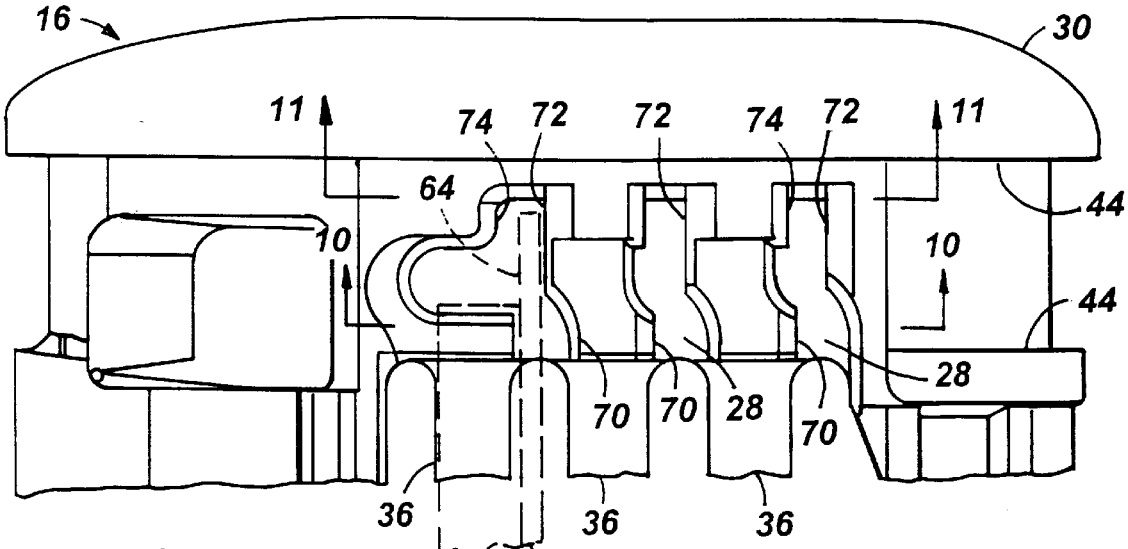
FIG. 9 is a partial plan view showing an end of a housing of a cartridge of a FIG. 2 blade unit.
Figure 10:
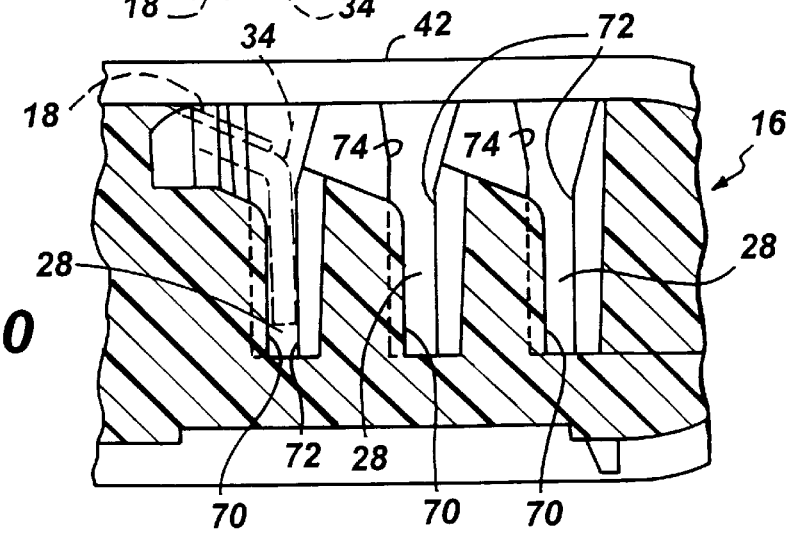
FIG. 10 is a vertical sectional view, taken at 10—10 of FIG. 9, of the FIG. 9 cartridge housing.

Referring to FIGS. 9 and 10, the surfaces of front stop portion 70 and back stop portion 72 are in respective planes that are spaced from each other along axes parallel to axes 52 (shown on FIG. 2) by a distance that is slightly more than the thickness of base portion 32 to limit forward and backward movement and pivoting of base portion 32 and to thereby provide for controlled linear up and down movement along third axes 54. This spacing is best shown in FIG. 10, in which the section is taken through front stop portion 70. The surface of back stop portion 72 is parallel to third axes 54 (FIG. 2), and the surface of front stop portion 70 makes a ¼ degree or less angle with axes 54. Base portion 32 is made of 0.28 mm±0.01 mm (0.011"±0.0004") thick metal, and the distance between planes of the surfaces of front stop portion 70 and back stop portion 72 (as shown in FIG. 10) is 0.33 mm+0.03 mm−0.013 mm (0.0131"+0.0012"−0.0005") at the bottom of the slots. The front stop portions 70 and back stop portions 72 thus have surfaces in planes that are spaced by a distance that is less than or equal to 0.09 mm (0.0035") greater than the thickness of the base portion 32. This almost parallel arrangement (as opposed to the more divergent faces of the prior art) and the tightened space for base portion 32 provide more consistent blade position and consistent blade angle during shaving.

Figure 11:
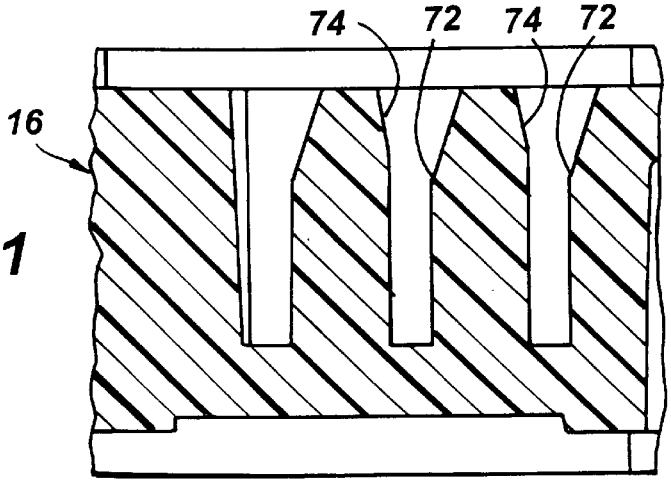
FIG. 11 is a vertical sectional view, taken at 11—11 of FIG. 9, of the FIG. 9 cartridge housing.

FIG. 11 is a section taken further outward (i.e., closer to the end of the housing), and the section passes between the end of a back stop portion 72 and the opposing anti-rolling member 74, which is higher than the associated front stop portion 70 (see FIGS. 8 and 10) and is spaced further (along axes parallel to second axes 52) from back stop portion 72. As is shown on FIGS. 8 and 9, the anti-rolling member 74 is out beyond the end of blade 18 and upper support 62 thereunder and thus will not interfere with travel of blade 18 up and down, even if blade support 34 shifts all the way to one end of housing 16 or the other. While front facing burrs 66 are aligned with anti-rolling members 74, there is a larger space between the front of base portion 32 and member 74 than there is between the front of base portion 32 and front stop portion 70, and there is less concern for interference of burr 66 against an opposing housing surface than there otherwise would be if the tight spacing were provided at the burr 66.

Because front stop portion 70 is underneath the blade 18, it must have a lower height than if it were out beyond blade 18. With a lower height at the front, under extreme force conditions, such as dropping of a cartridge or knocking against a surface, blades 18 and bent supports 34 could be rocked forward out of position if it were not for the existence of anti-rolling members 74, which are at a higher elevation. Because anti-rolling members 74 are located beyond blade 18, they do not interfere with its travel.

As can best be seen from FIG. 9, front stop portion 70 and back stop portion 72 are offset from each other with a large space behind front stop portion 70. There similarly is a large space in front of the majority of the back stop portion 72. This facilitates and permits the use of thinner plastic walls and extra mold pieces to facilitate molding without distortion of the plastic.

In manufacture, bent supports 32 are made by stamping and bending, resulting in burrs 66, and blades 18 are welded to upper portions 62 of blade supports 34 at welds 60 (FIG. 5). The attached blades 18 and blade supports 34 are mounted on housing 16 by inserting support ends 64 in slots 28 and depressing the blades and blade supports downward against resilient arms 36. Guard 20 and cap 22 are similarly mounted on housing 16 prior to attaching retaining clips 42, which hold the blades in place with the cutting edges of the blades resting against clips 42 when in the rest position shown in FIG. 4. Resilient arms 36 bias the blades upward against clip 42 and, owing to the angle of upper portion 66 of blade support 34, bias base portion 32 of blade support 34 against back stop member 72.

During shaving, blades 18 move up and down, with the back surfaces of base portions 32 sliding against back stop members 72.

Other embodiments of the invention are within the scope of the appended claims.

What is claimed is:

1. A razor cartridge comprising:

a housing having an elongated blade receiving region that extends along a longitudinal axis, said region being defined between two side walls that are spaced apart from each other and between a guard and a cap that are spaced apart from each other, said two side walls being on opposite sides of said elongated blade receiving region, said guard and said cap being on opposite sides of said elongated blade receiving region, said housing having parallel first axes that are parallel to said longitudinal axis and extend from one side wall to the other, said housing having parallel second axes that are transverse to said first axes and extend from said guard to said cap, said housing also having blade-receiving slots in said side walls that face each other and extend along third axes that are transverse to both said first and second axes, and elongated blade members having blades with cutting edges that extend parallel to said first axes, said blade members also having bent supports that extend downward from said blades and have support ends at the ends of the blade members that are mounted for movement in said slots along said third axes, each said slot being defined by a front stop portion and a back stop portion of said housing on opposite sides of said bent support, said front stop portion of said slot being closer to said guard than said cap, said back stop portion of said slot being closer to the cap than said guard, said front stop portions preventing said bent supports from moving forward beyond the front stop portions toward said guard, said back stop portions preventing said bent supports from moving rearward beyond said back stop portions toward said cap, said front stop portions being located underneath said blades, said back stop portions being located along some of said first axes outside of said front stop portions in a direction away from the blade receiving region, said some of said first axes being axes that intersect said back stop portions.

2. The cartridge of claim 1 wherein said back stop portions extend along respective third axes higher than said front stop portions.

3. The cartridge of claim 1 wherein said support ends extend along said first axes beyond said blades.

4. The cartridge of claim 2 wherein said support ends extend along said first axes beyond said blades.

5. The cartridge of claim 4 wherein the side walls also include anti-rolling members located on the same side of said first axes as said front stop portions beyond said blades.

6. The cartridge of claim 5 wherein said anti-rolling members extend along respective third axes higher than said front stop portions.

7. The cartridge of claim 1 wherein said front and back stop portions have surfaces that make an angle of less than 1 degree with said third axes.

8. The cartridge of claim 1 wherein said front and back stop portions have surfaces that make an angle of less than ½ degree with said third axes.

9. The cartridge of claim 8 wherein said front stop portions have surfaces that make an angle of less than ½ degree with said third axes, and said back stop portions have surfaces that are parallel to said third axes.

10. The cartridge of claim 9 wherein said front stop portions and back stop portions have surfaces in planes that are spaced by a distance that is less or equal to 0.09 mm (0.0035") greater than the thickness of said bent support.

11. The cartridge of claim 1 wherein said support ends have burrs at the ends of the support ends that face toward said guard, said burrs being outside of said front stop portions.

* * * * *